US008152459B2

(12) United States Patent
Sonoda et al.

(10) Patent No.: US 8,152,459 B2
(45) Date of Patent: Apr. 10, 2012

(54) AIRFOIL FOR AXIAL-FLOW COMPRESSOR CAPABLE OF LOWERING LOSS IN LOW REYNOLDS NUMBER REGION

(75) Inventors: Toyotaka Sonoda, Saitama (JP); Markus Olhofer, Offenbach (DE); Martina Hasenjaeger, Offenbach (DE); Heinz-Adolf Schreiber, Bonn (DE)

(73) Assignee: Honda Motor Co., Ltd., Tokyo (JP)

( * ) Notice: Subject to any disclaimer, the term of this patent is extended or adjusted under 35 U.S.C. 154(b) by 1045 days.

(21) Appl. No.: 11/790,865

(22) Filed: Apr. 27, 2007

(65) Prior Publication Data

US 2008/0181780 A1 Jul. 31, 2008

(30) Foreign Application Priority Data

Apr. 28, 2006 (DE) ..... 10 2006 019 946

(51) Int. Cl.
*F01D 9/04* (2006.01)
*F01D 5/14* (2006.01)

(52) U.S. Cl. ..... 415/181; 415/191; 415/208.2; 415/211.2; 415/914; 416/223 A; 416/243; 416/DIG. 2; 416/DIG. 5

(58) Field of Classification Search ..... 415/181, 415/191, 208.1, 208.2, 210.1, 211.2, 914; 416/223 R, 223 A, 243, DIG. 2, DIG. 5
See application file for complete search history.

(56) References Cited

U.S. PATENT DOCUMENTS

| | | | | |
|---|---|---|---|---|
| 4,519,746 | A * | 5/1985 | Wainauski et al. | 416/223 R |
| 5,554,000 | A * | 9/1996 | Katoh et al. | 415/208.2 |
| 6,565,323 | B2 * | 5/2003 | Kim | 416/223 R |
| 2004/0228732 | A1 * | 11/2004 | Sonoda et al. | 416/223 R |
| 2008/0118362 | A1 * | 5/2008 | Hu et al. | 416/223 A |

FOREIGN PATENT DOCUMENTS

| | | | |
|---|---|---|---|
| JP | 9-256998 | A | 9/1997 |
| JP | 2002-317797 | A | 10/2002 |
| JP | 2004-293335 | A | 10/2004 |

* cited by examiner

*Primary Examiner* — Christopher Verdier
(74) *Attorney, Agent, or Firm* — Birch, Stewart, Kolasch & Birch, LLP

(57) ABSTRACT

In a transonic region with a Reynolds number not more than a critical Reynolds number, a flow velocity distribution on an extrados of an airfoil has a single supersonic maximum value within a range of up to 6% from a leading edge on a chord, or a shape factor has a maximum value in a region of 6 to 15% from the leading edge on the chord, the value being nearly constant in a region of 30 to 60% and gradually can increase up to 2.5 in a region downstream of 60% of chord. A pressure loss in a low Reynolds number region can be drastically reduced, while conventionally keeping low the pressure loss in a high Reynolds number region. Moreover, this pressure-loss reduction effect in the low Reynolds number region is exerted even if an inflow angle is changed in a wide range.

17 Claims, 7 Drawing Sheets

(EMBODIMENT)

(EMBODIMENT)

AIRFOIL FOR AXIAL-FLOW COMPRESSOR CAPABLE OF LOWERING LOSS IN LOW REYNOLDS NUMBER REGION

CROSS-REFERENCE TO RELATED APPLICATIONS

The present application claims priority under 35 USC 119 to German Patent Application No. 10 2006 019 946.4 filed on Apr. 28, 2006 the entire contents of which are hereby incorporated by reference.

BACKGROUND OF THE INVENTION

1. Field of the Invention

The present invention relates to an airfoil which is suitably used for a blade cascade of an axial-flow compressor for transonic velocity of an aircraft engine. More particularly, to an airfoil that is capable of a drastic reduction of a pressure loss in a low Reynolds number region not more than a critical Reynolds number that corresponds to a starting point below which the total pressure losses increase considerably.

2. Description of Background Art

Currently, as an airfoil is known that is widely used in a blade cascade (rotor blade, stator vane, outlet guide vane) for an axial-flow compressor for small to large-size state-of-the-art aircraft engines, Controlled Diffusion Airfoil (CDA). In this CDA, a maximum flow velocity on an extrados of a blade in a transonic regime is generated over a portion of the suction surface from 10 to 30% of a chord. A concept of its design is to provide a flow velocity distribution wherein the flow velocity is reduced from supersonic to subsonic without a shock wave so that shock losses are eliminated and the boundary layer is not separated due to shock-boundary layer interaction.

Japanese Patent Application Laid-open No. 2002-317797 discloses an airfoil in which a surface having a surface roughness that is relatively larger on a front half part of a portion from a leading edge to an extrados than a rear half part is formed on the airfoil so as to suppress the generation of laminar flow separation bubbles and to suppress the development of a turbulent boundary layer in a low Reynolds number region as well as to prevent a decrease in a surge allowance, thereby improving efficiency of the compressor.

Also, Japanese Patent Application Laid-open No. 2004-293335 discloses an airfoil in which a supersonic portion having a substantially constant flow velocity is formed in a region downstream of a first maximum flow velocity value on an extrados of an airfoil for a compressor and within 15% on a chord so that a large first shock wave is generated at a position where the flow velocity becomes the first maximum value, thereby weakening a second shock wave generated at a position where the flow velocity becomes substantially a constant supersonic velocity. Thus, a boundary layer separation due to the second shock wave is suppressed to reduce a pressure loss.

It is very important for an aircraft engine to reduce the weight. The weight of LP turbine accounts for roughly one third of the total engine weight, because it consists of several stages. An idea of reducing the number of turbine components is to include a high turning compressor stator as an outlet guide vane (OGV) just behind an extremely high loaded turbine rotor. However, the operating Reynolds number varies greatly between take-off and cruise condition. As a result, airfoils of conventional medium and high Reynolds number CDA design do have problems at cruise conditions at a low Reynolds number region less than a critical Reynolds number. Indeed, the OGV losses could dramatically increase below a certain Reynolds number, so that a sufficient performance of the aero engine cannot be achieved.

Total pressure losses of conventional aero engine compressor bladings also increase tremendously at very high altitude cruise (i.e. above 40000-45000 ft) at which the blade chord Reynolds number is very low because of the low air density.

SUMMARY AND OBJECTS OF THE INVENTION

The present invention has been conducted in view of the above circumstances. It is an object of an embodiment of the present invention to reduce a pressure loss in a low Reynolds number region without losing performance in a high Reynolds number region of an airfoil for an axial-flow compressor.

In order to achieve the above object, according to a first feature of the present invention, a new type of airfoils is provided for an axial-flow compressor capable of lowering the total pressure loss in a low Reynolds number region. An intrados is adapted to generate a positive pressure between a leading edge and a trailing edge and an extrados is adapted to generate a negative pressure between the leading and trailing edges. A flow velocity distribution on the extrados side has a single supersonic maximum value within a range of up to 6% from the leading edge on a chord with a position of the leading edge represented by 0% and a position of the trailing edge represented by 100%.

According to an embodiment of the present invention, a supersonic region in the flow velocity distribution on the extrados side is limited within a range of up to 15% from the leading edge on the chord.

According to an embodiment of the present invention, a blade thickness distribution on a leading edge portion has an inflection point.

According to an embodiment of the present invention, the inflection point exists in a range of 3 to 20% from the leading edge on the chord.

According to an embodiment of the present invention, the supersonic maximum value is not more than Mach 1.3.

According to an embodiment of the present invention, the airfoil is adopted at least in a part of a span direction of a stator vane or a rotor blade of a compressor.

According to an embodiment of the present invention, there is provided an airfoil for an axial-flow compressor that is capable of lowering the loss in a low Reynolds number region. An intrados is adapted to generate a positive pressure between a leading edge and a trailing edge. An extrados is adapted to generate a negative pressure between the leading and trailing edges. A boundary layer shape factor on the extrados has a maximum value in a region of 6 to 15% from the leading edge on a chord with a position of the leading edge represented by 0% and the position of the trailing edge represented by 100%, the value being substantially constant in a region of 30 to 60% and gradually increased in a region in the rear of 60%.

According to an embodiment of the present invention, a maximum value of the boundary layer shape factor at the trailing edge is not more than 2.5.

According to an embodiment of the present invention, a blade thickness distribution of a leading edge portion has an inflection point.

According to an embodiment of the present invention, the inflection point exists in a range of 3 to 20% from the leading edge on the chord.

According to an embodiment of the present invention, the airfoil is adopted at least in a part of a span direction of an outlet guide vane or a stator vane or a rotor blade of a compressor.

According to the embodiments of the present invention, in a transonic regime with a Reynolds number not more than a certain critical Reynolds number, a flow velocity distribution on an extrados of an airfoil has a single maximum of the supersonic flow within a range of up to 6% from a leading edge on a chord, and a maximum value of the boundary layer shape factor in a region of 6 to 15% from the leading edge on the chord, the level of the shape factor remains substantially constant in a region of 30 to 60% and gradually increases in a region downstream of 60% of blade chord. In relation to a conventional airfoil (CDA) design that shows velocity maxima around 15-30% of blade chord the new cascade airfoil is designed with a flow velocity maximum immediately after the leading edge on the extrados of the airfoil. As a result, a small shock wave or a system of small shock waves could arise close behind the leading edge, but the flow deceleration of this shock wave or system of small shock waves promotes transition from a laminar boundary layer to a turbulent boundary layer, so that the turbulent boundary layer downstream of transition is kept in a remarkably stable state and the boundary layer on the extrados remains far from separation. Furthermore, early shock induced boundary layer transition helps to avoid extended laminar separations with risk of the burst of a laminar separation bubble and severe extended separations.

Thus, the pressure loss in a low Reynolds number region can be drastically reduced, while a pressure loss in a high Reynolds number region remain in a conventionally low level. Moreover, this pressure-loss reduction effect in the low Reynolds number region remains, even if an inflow angle is changed in a wide range.

For transonic, low Reynolds number operation, it is preferable that the supersonic region on the extrados of the airfoil is regulated within a range of up to 15% from the leading edge on the chord, the maximum value in the supersonic region is regulated to be not more than Mach 1.3, and a position of the inflection point of blade thickness distribution of the leading edge portion of the airfoil is regulated within a range of 3 to 20% from the leading edge on the chord, whereby a weak shock wave is generated in a portion extremely close to the leading edge so that transition from the laminar boundary layer to the turbulent boundary layer is accelerated.

Moreover, it is preferable that a value of the boundary layer shape factor at the trailing edge is regulated to 2.5 or less, thereby preventing separation of a boundary layer in the vicinity of the trailing edge which has been generated in a conventional airfoil.

The airfoil according to the present invention can be adopted at least at a part in the span direction of an outlet guide vane and it is advantageously adopted at a portion on a stator vane or rotor blade of a compressor in which the Reynolds number is low.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In this specification, an arbitrary position X along a chord of a length C of an airfoil is indicated by a ratio X/C with a position of a leading edge 11 represented by 0% and a position of a trailing edge 12 represented by 100%.

Figure 1:
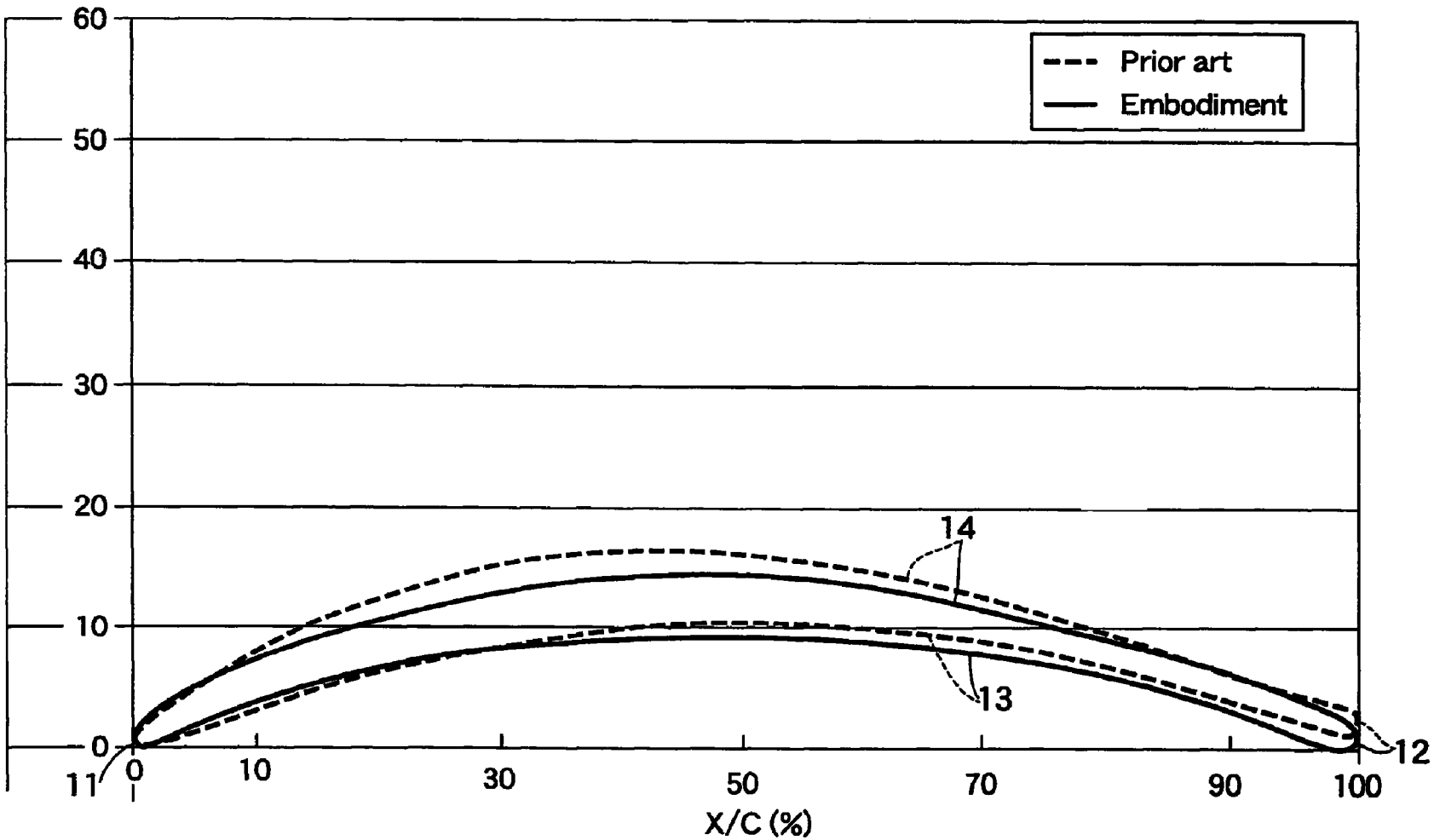
FIG. 1 is a diagram showing an airfoil of an embodiment according to the present invention and a conventional airfoil.
Figure 7:
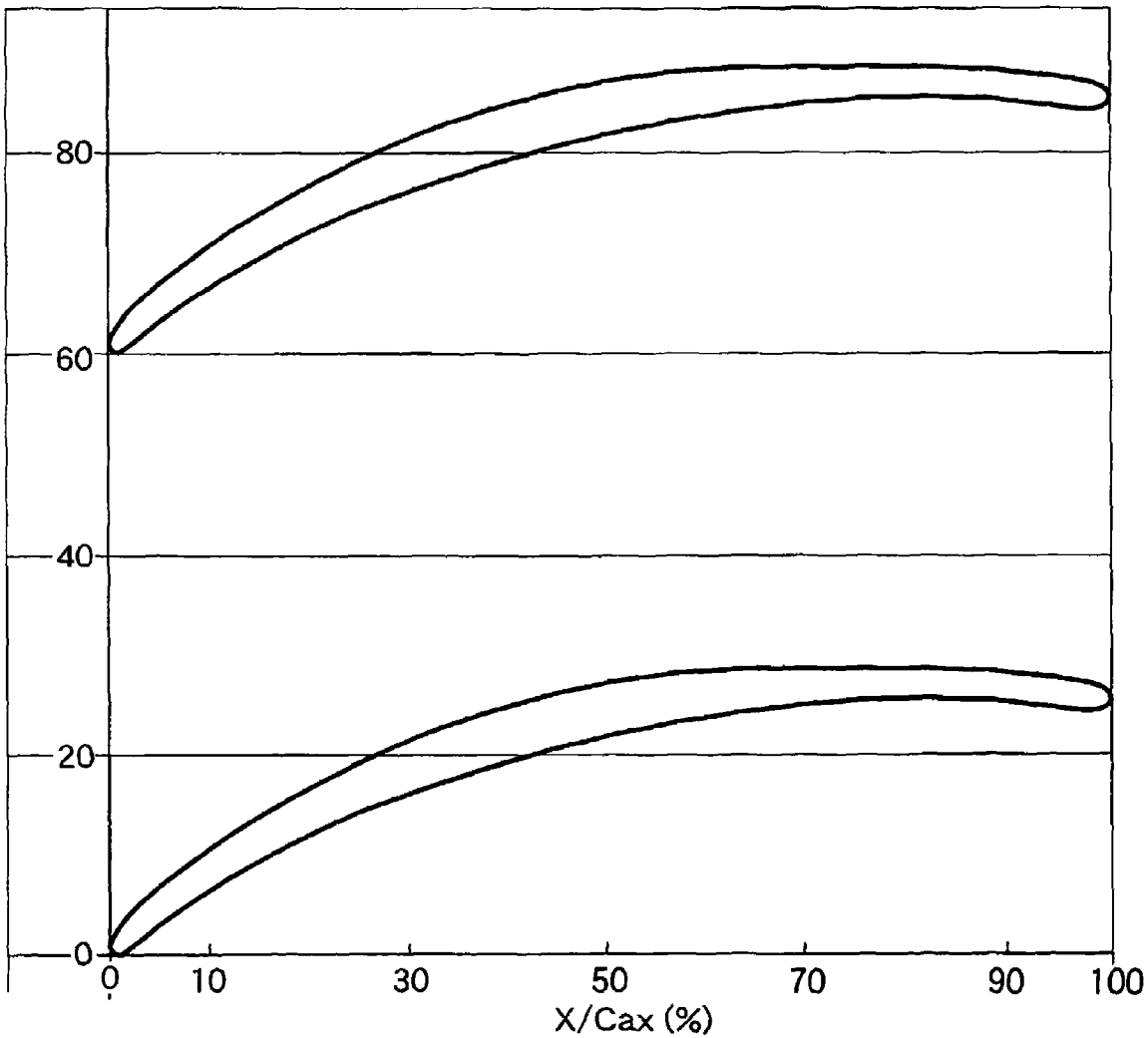
FIG. 7 is a diagram showing a blade cascade using the airfoil of the embodiment.

FIG. 1 shows an airfoil used in a compressor blade of an aircraft turbo fan engine (outlet guide vane), in which a solid line corresponds to an embodiment and a broken line to a conventional airfoil (CDA: Controlled Diffusion Airfoil). This stator vane is radially arranged around an axis in the downstream of a rotor blade, and constitutes a blade cascade as shown in FIG. 7.

Figure 2:
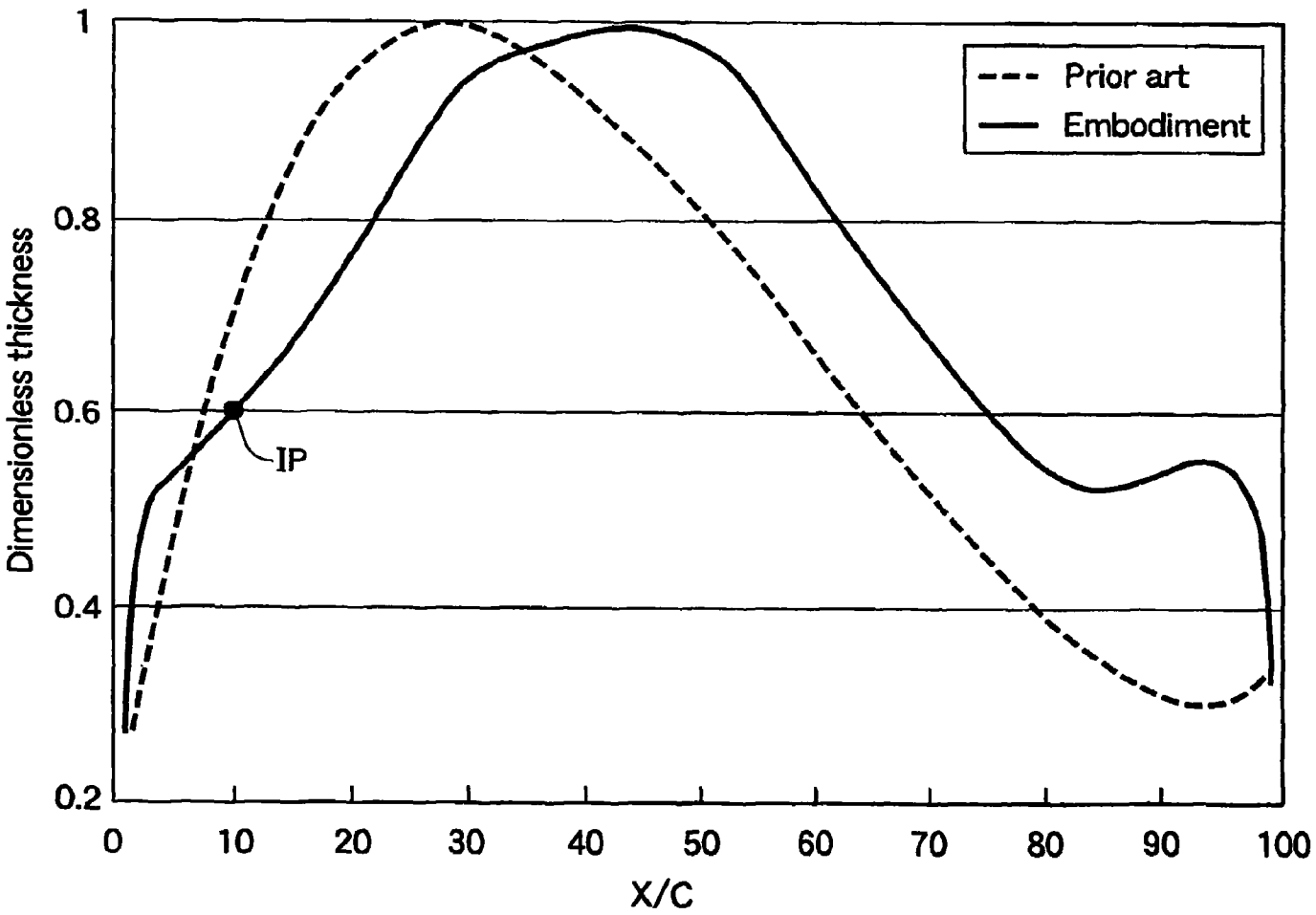
FIG. 2 is a diagram showing blade thickness distributions along chords of the airfoil of the embodiment and the conventional airfoil.

FIG. 2 shows a distribution of blade thickness along the chord (made dimensionless by chord length), in which a solid line indicates an embodiment and a broken line indicates a conventional airfoil. The blade thickness distribution of the airfoil of the embodiment has an increase of the blade thickness from the leading edge 11 to the maximum blade thickness position which is moderate in relation to that one of the conventional design except at a position immediately at the leading edge 11. More particularly, the blade thickness of the conventional airfoil is monotonously increased from the leading edge 11 toward the maximum blade thickness position in the vicinity of 30% of the chord, while the blade thickness of the airfoil of the embodiment is provided with an inflection point IP between the leading edge 11 and the maximum blade thickness position in the vicinity of 45% of the chord (in the vicinity of 10% of the chord). More particularly, the blade thickness of the airfoil of the embodiment is rapidly increased from the leading edge 11 to the vicinity of 3% of the chord, and then with a lowered increase rate, it reaches the inflection point IP, from which the increase rate becomes large again. The combination of "rapid increase rate of the blade thickness immediately after the leading edge 11" and the "decrease of blade thickness rate around the inflection point" leads to a rapid increase of flow velocity on an extrados 14 immediately after the leading edge 11. The onset of flow-deceleration immediately behind the velocity maximum promotes boundary layer transition on the front portion of the extrados and subsequent development of a turbulent, stable boundary layer on a rear half part of the blade without separation. Furthermore, the early onset of flow deceleration on the extrados allows to reduce the ratio of flow deceleration on the rear part to a level which is lower than those existing on conventional compressor airfoils. A long distance of deceleration and a reduced pressure gradient on the rear part of the suction side keep the boundary layer healthy and apart from separation (boundary layer shape factor: below 2-2.5).

Figure 3A:
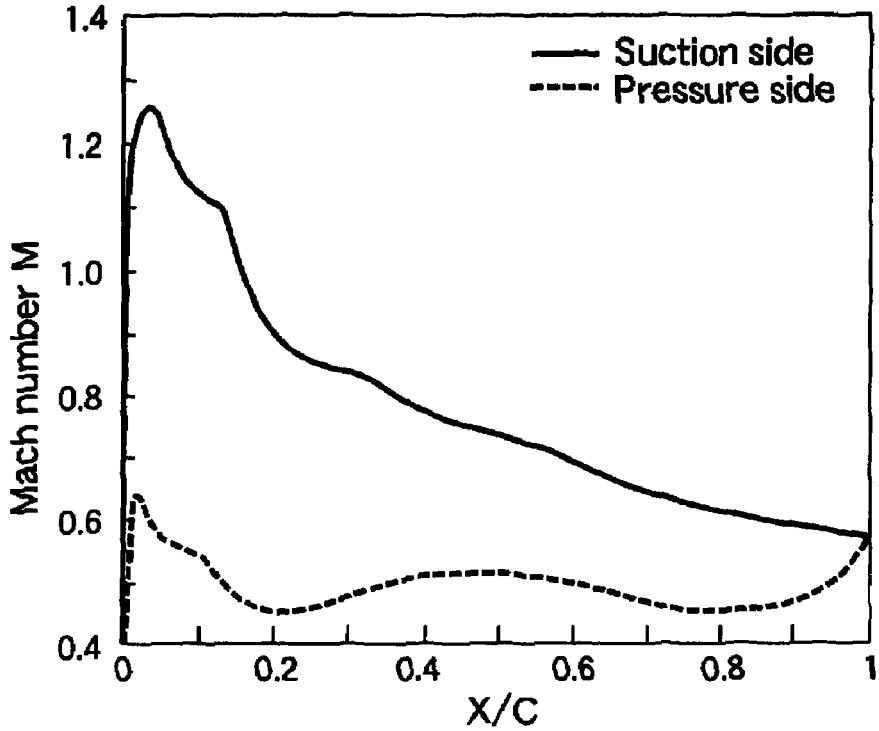
FIG. 3A is a diagram showing a flow velocity distribution along the chord of the airfoil of the present embodiment.
Figure 3B:
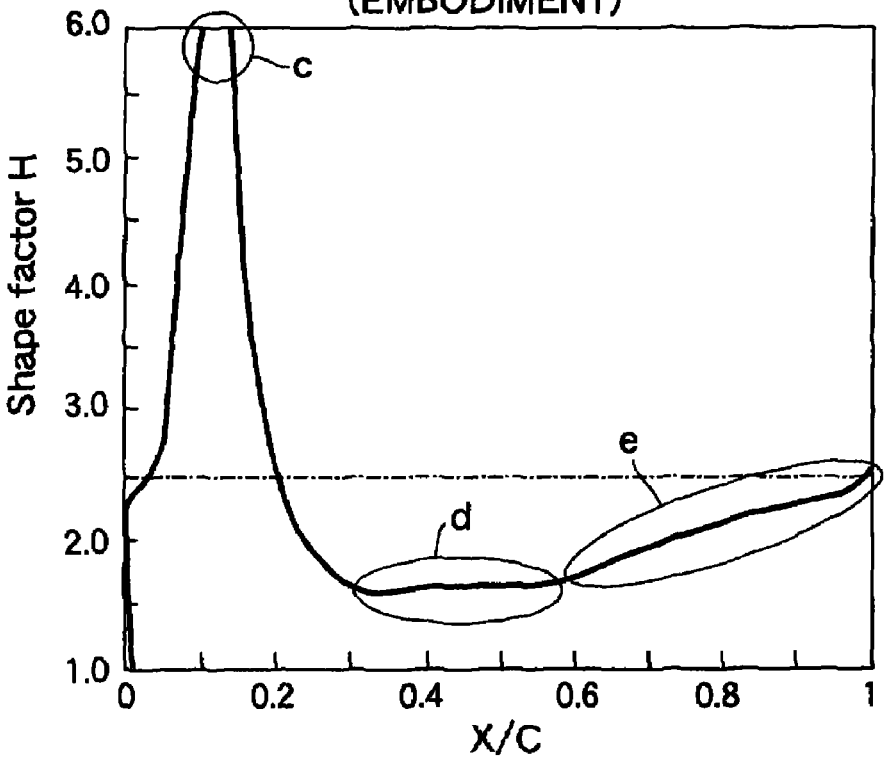
FIG. 3B is a diagram showing a boundary layer shape factor distribution along the chord of the airfoil of the embodiment.

FIG. 3A shows a distribution of Mach number M along the chord of the airfoil of the embodiment, while FIG. 3B shows a distribution of a boundary layer shape factor H along the chord of the airfoil.

When a flow velocity of a main stream is U, a flow velocity of a boundary layer is u and a distance measured perpendicularly from the surface of the airfoil is y, a displacement thickness of a boundary layer $\delta^*$ is defined by $\delta^*=\int\{(U-u)/U\}\,dy$. In addition, when a flow velocity of a main stream is U, a flow velocity of a boundary layer is u and a distance measured perpendicularly from the surface of the airfoil is y. Thus, a momentum thickness of a boundary layer $\theta$ is defined by $\theta=\int\{u(U-u)/U^2\}\,dy$. Further, the shape factor H is defined by $H=\delta^*/\theta$. H is the effective boundary layer shape factor (ratio of the boundary layer displacement- to boundary layer momentum thickness) of an equivalent incompressible boundary layer.

Figure 4A:
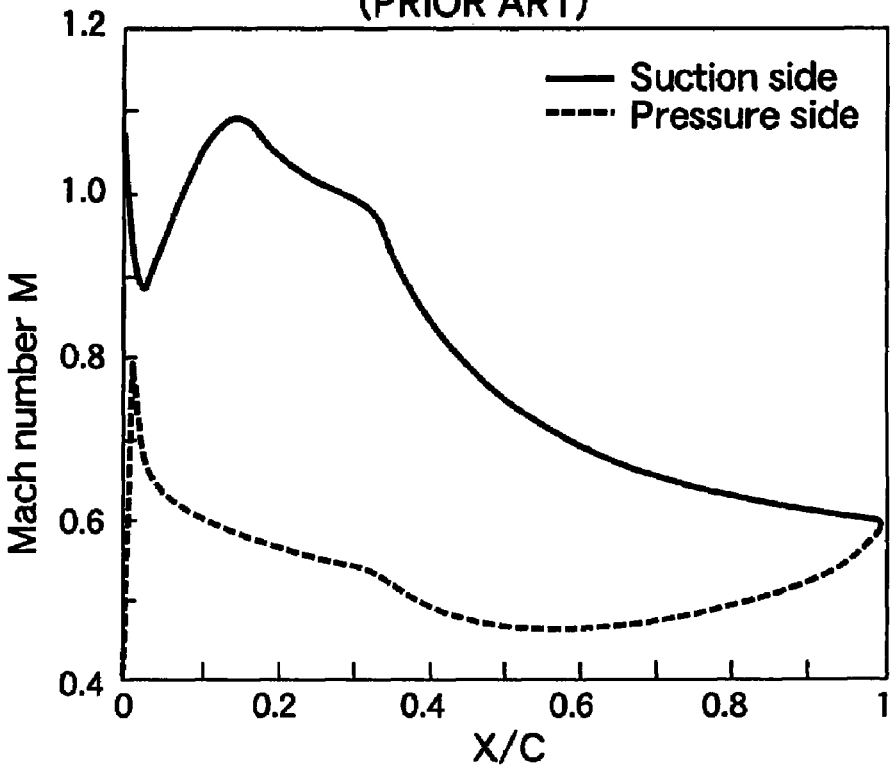
FIG.4A (PRIOR ART)
FIG. 4A is a diagram showing a flow velocity distribution along the chord of the conventional airfoil.

FIG. 3A and FIG. 4A show velocity distributions of the intrados 13 and an extrados 14 of the airfoil of the embodiment and the conventional airfoil, respectively, and a particularly significant difference is found therebetween in the velocity distribution on the extrados 14. More particularly, the flow velocity distribution on the extrados 14 of the conventional airfoil may show a local velocity peak at the leading edge 11 (here Mach 1.07, shown in FIG. 4A) but immediately after the leading edge 11, of the chord a continuous flow acceleration starts from Mach 0.88 to reach a maximum velocity value with Mach 1.10 at a 15% position of the chord. The region of supersonic flow velocity (M>1.00) extends up to a 30% position of the chord, and then the flow velocity is moderately decreased to Mach 0.60 at the trailing edge 12. Downstream of the velocity maximum an intensive laminar separation bubble develops and extends up to 45% of chord.

On the other hand, the flow velocity distribution on the extrados 14 of the airfoil of the embodiment shown in FIG. 3A has a maximum value of Mach 1.26 at a 4% position of the chord, which is extremely close to the leading edge 11, and the flow velocity decreases to Mach 1.00 or less downstream from a 15% position of the chord from the leading edge 11. A characteristic that a maximum value of the flow velocity is extremely biased to the leading edge 11 side as compared with the conventional airfoil in this way depends on the blade thickness distribution such as a rapid increase in the blade thickness immediately after the leading edge 11 (in a region up to 3% of the chord in the embodiment) and a relatively constant blade thickness from the inflection point IP to the 30% position of the chord on the downstream side (see FIG. 2). With this blade thickness distribution, the maximum value of the flow velocity is moved to a position closer to the leading edge 11 than that in the flow velocity distribution of the conventional airfoil (see FIG. 4A), whereby a steep pressure rise with a weak shock wave is generated immediately after the leading edge 11. This pressure rise with strong deceleration induces a transition of the boundary layer from a laminar state to a turbulent one. The turbulent boundary layer better can withstand strong diffusion in relation to a laminar boundary layer. So the turbulent boundary layer is maintained stable up to the trailing edge 12.

Figure 4B:
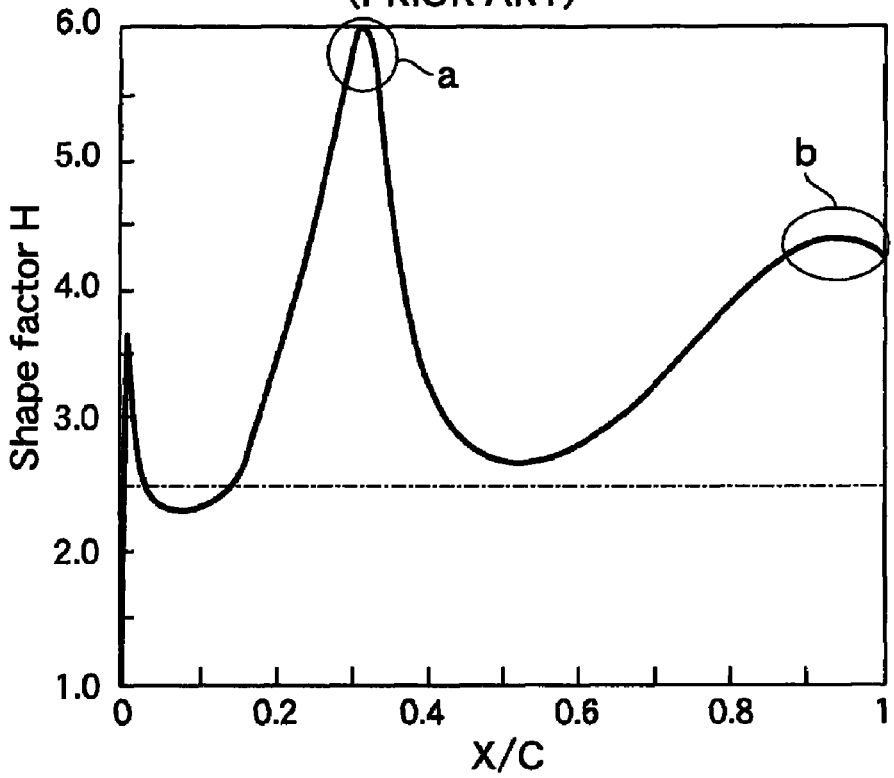
FIG.4B (PRIOR ART)
FIG. 4B is a diagram showing a boundary layer shape factor distribution along the chord of the conventional airfoil.

The above operation will be described in more detail based on the shape factor H shown in FIGS. 3B and 4B for flow conditions at low blade chord Reynolds numbers (i.e. Re=120000 and M-inlet=0.76). As is to be seen from FIG. 4B, in the conventional airfoil, a maximum value of the shape factor H exists in the vicinity of 30% of the chord (see portion a) where extended laminar flow separation occurs. Because of the poor state of the boundary layer and the rear pressure rise, the boundary layer does not reattach. The shape factor H value remains above a value of 2.5 and increases up to 4.3 in the vicinity of the trailing edge 12 (see portion b) which indicates severe turbulent separation.

On the other hand, the shape factor H of the embodiment shown in FIG. 3B has a maximum value at a 12% position of the chord (see portion c) which indicates a transition in a short laminar separation bubble which is induced by a weak shock wave. The shape factor H decreases well below 2.0 at a 20% position of the chord. The shape factor H is maintained substantially constant in a region of 30 to 60% of the chord (see portion d). In addition, the shape factor H gradually can increase but is kept lower than a value of 2.5 before reaching the trailing edge 12 (see portion e). In this way, the transition of a boundary layer is caused in a region close behind the leading edge 11 and a stable turbulent boundary layer is formed on the extrados 14 of the airfoil in a wide region of 20 to 100% of the chord. Thus, the rear turbulent separation of the boundary layer can be prevented and the pressure loss can be minimized.

Figure 5:
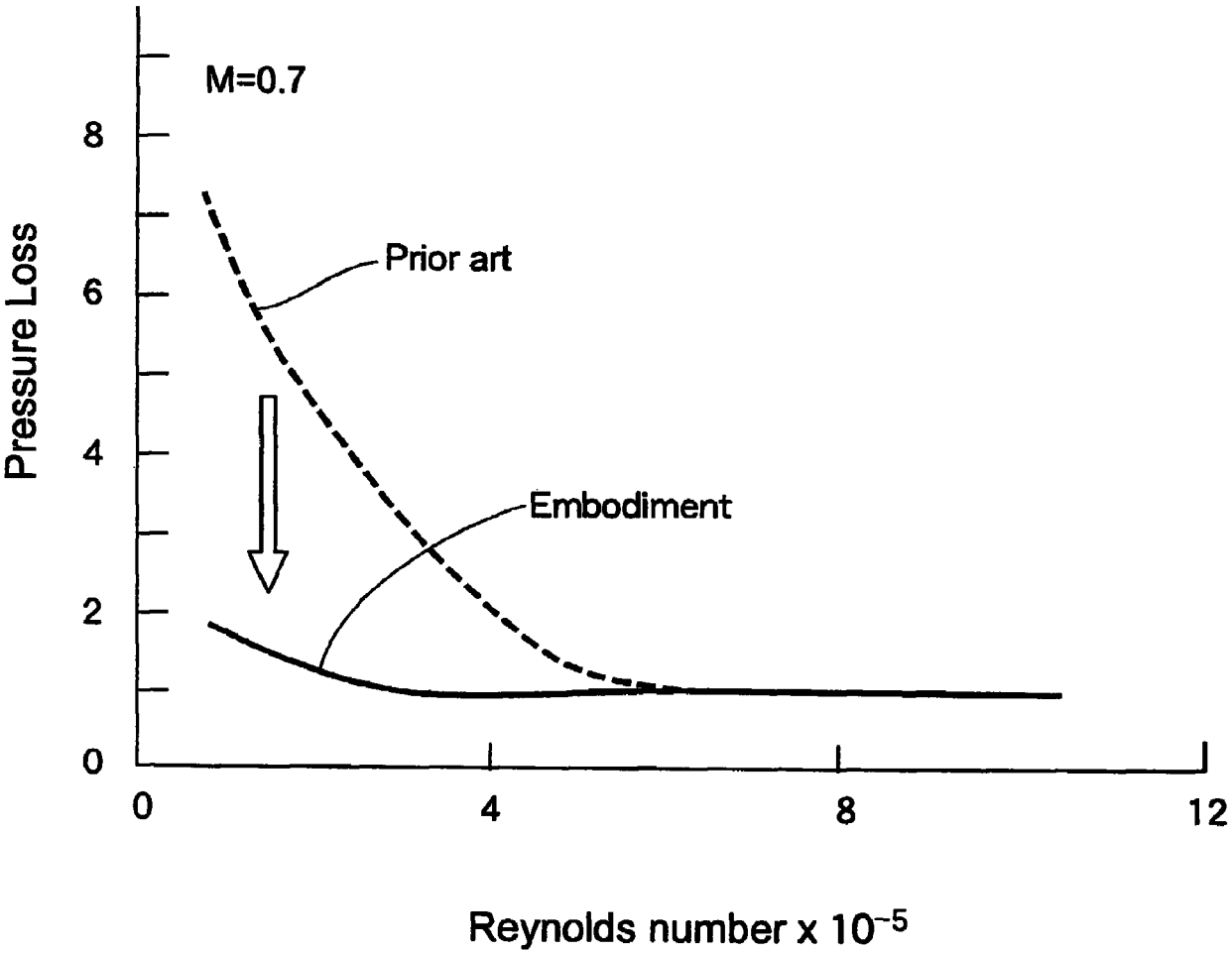
FIG. 5 is a diagram showing a change in a pressure loss with respect to Reynolds number.

FIG. 5 shows an example of the change of pressure losses with respect to the Reynolds number for a mainstream inlet Mach number of 0.7. The pressure loss of the airfoil of the embodiment can be made smaller than that of the conventional airfoil in a region with the Reynolds number of less than 400000, while keeping the pressure loss of the airfoil of the embodiment at the same level as that of the conventional airfoil in a region with the Reynolds number of 600000 or more. The smaller the Reynolds number is, the more significant the pressure-loss reduction effect of the airfoil of the embodiment. Thus, the pressure loss of the airfoil of the embodiment at the Reynolds number of 120000 is only approximately one fourth of those of the conventional airfoil.

Figure 6:
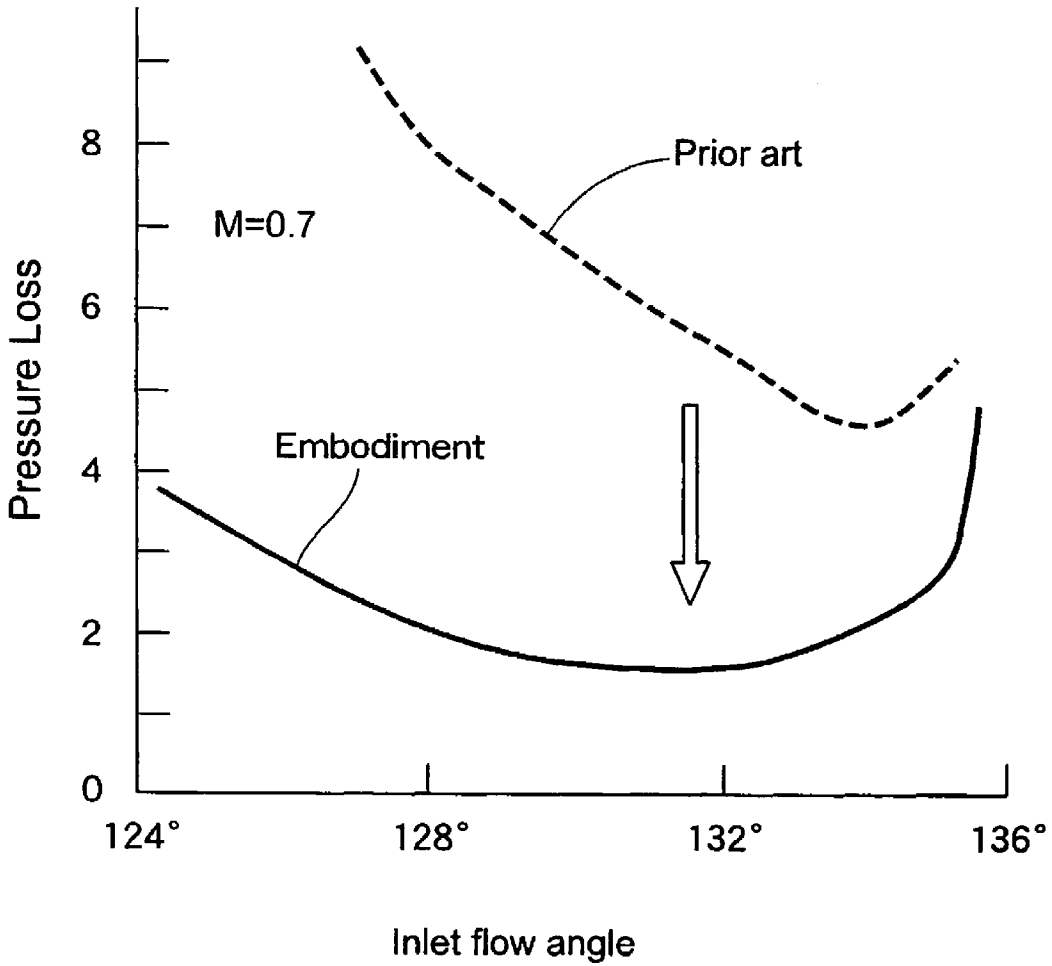
FIG. 6 is a diagram showing a change in a pressure loss with respect to the inflow angle.

FIG. 6 shows the characteristic change of pressure losses with respect to an inflow angle (angle made by the mainstream with respect to a line connecting the leading edges of the blade cascade) at a mainstream inlet Mach number of 0.7, and a pressure loss of the airfoil of the embodiment when the Reynolds number is 120000 and the inflow angle is 130°, for example, is kept approximately one fourth of that of the conventional airfoil.

FIG. 7 shows a part of a blade cascade using the airfoil according to the present invention. The vertical axis and longitudinal axis of this diagram is represented by percentage based on a cord Cax (axis chord) along a rotational axis of a compressor.

The embodiment of the present invention has been described above, but it is possible to make various design changes without deviating from the subject matter of the present invention.

For example, a maximum value of the flow velocity of the airfoil of the embodiment is located at a 4% position of the chord, but it is sufficient that the position of the maximum value is within a 6% position of the chord.

Also, the final part of the supersonic portion of the airfoil of the embodiment is located at a 15% position of the chord, but it is sufficient that the final part of the supersonic portion is in the front of the 15% position of the chord.

Also, the maximum value of the flow velocity of the airfoil of the embodiment is Mach 1.26, but it is sufficient that the maximum value of the flow velocity is not more than Mach 1.30.

Also, the inflection point IP of the blade thickness of the airfoil of the embodiment is located at a 10% position of the chord, but it is sufficient that the point is within a range of 3 to 20% of the chord.

Also, a maximum value of the boundary layer shape factor H of the airfoil of the embodiment is located at a 12% position of the chord, but it is only necessary that the maximum value is within a range of 6 to 15% of the chord.

Also, the maximum value of the shape factor H at the trailing edge 12 of the airfoil of the embodiment is 2.5, but it is sufficient and even better that the value is less than 2.5.

Also, the airfoil of the embodiment may be adopted over the whole region in the span direction (blade height direction) or only at a part in the span direction. More particularly, the airfoil of the present invention may be adopted for a part of the outlet guide vane in the spanwise direction, while another airfoil may be adopted for the remaining part. In this way, by appropriately using the airfoil of the present invention and the existing airfoil, the design freedom of the blade can be improved.

Also, the application of the airfoil of the present invention is not limited to an outlet guide vane of a compressor for a turbo fan engine, but it is also applicable to a rotor blade or a stator vane of any other arbitrary aircraft engine compressor.

An essential advantage is achieved when adopting the embodiment to aero engine compressors which operate at high altitude cruise where the blade chord Reynolds numbers are low in the rotor as well as in the stator bladings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An airfoil for an axial-flow compressor capable of lowering loss in a low Reynolds number region, comprising:

an intrados adapted to generate a positive pressure between a leading edge and a trailing edge and an extrados adapted to generate a negative pressure between said leading and trailing edges;

wherein a flow velocity distribution on the extrados side has a single supersonic maximum value within a range of up to 6% from the leading edge on a chord with a position of the leading edge represented by 0% and a position of the trailing edge represented by 100%, such that the flow velocity distribution gradually increases from the position of 0% and reaches the single supersonic maximum value and then gradually decreases from the maximum value to the position of 6%, wherein a blade thickness distribution on an airfoil front portion has an inflection point.

2. The airfoil for an axial-flow compressor capable of lowering loss in a low Reynolds number region according to claim 1, wherein a supersonic region in the flow velocity distribution on the extrados side is limited within a range of up to 15% from the leading edge on the chord.

3. The airfoil for an axial-flow compressor capable of lowering loss in a low Reynolds number region according to claim 2, wherein the airfoil is adopted at least in a part of a span direction of an outlet guide vane or a stator vane or a rotor blade of a compressor.

4. The airfoil for an axial-flow compressor capable of lowering loss in a low Reynolds number region according to claim 1, wherein the inflection point exists in a range of 3 to 20% from the leading edge on the chord.

5. The airfoil for an axial-flow compressor capable of lowering loss in a low Reynolds number region according to claim 4, wherein the airfoil is adopted at least in a part of a span direction of an outlet guide vane or a stator vane or a rotor blade of a compressor.

6. The airfoil for an axial-flow compressor capable of lowering loss in a low Reynolds number region according to claim 1, wherein the supersonic maximum value is not more than Mach 1.3.

7. The airfoil for an axial-flow compressor capable of lowering loss in a low Reynolds number region according to claim 6, wherein the airfoil is adopted at least in a part of a span direction of an outlet guide vane or a stator vane or a rotor blade of a compressor.

8. The airfoil for an axial-flow compressor capable of lowering loss in a low Reynolds number region according to claim 1, wherein the airfoil is adopted at least in a part of a span direction of an outlet guide vane or a stator vane or a rotor blade of a compressor.

9. An airfoil for an axial-flow compressor capable of lowering loss in a low Reynolds number region, comprising:

an intrados adapted to generate a positive pressure between a leading edge and a trailing edge and an extrados adapted to generate a negative pressure between said leading and trailing edges;

wherein a boundary layer shape factor on the extrados, which is a ratio between a displacement thickness of a boundary layer and a momentum thickness of the boundary layer, has a maximum value in a region of 6 to 15% from the leading edge on a chord with a position of the leading edge represented by 0% and the position of the trailing edge represented by 100%, the value being nearly constant in a region of 30 to 60% and gradually increasing in a region downstream of 60%.

10. The airfoil for an axial-flow compressor capable of lowering loss in a low Reynolds number region according to claim 9, wherein a maximum value of the shape factor at the trailing edge is less than 2.5.

11. The airfoil for an axial-flow compressor capable of lowering loss in a low Reynolds number region according to claim 10, wherein the airfoil is adopted at least in a part of a span direction of an outlet guide vane or a stator vane or a rotor blade of a compressor.

12. An airfoil for an axial-flow compressor capable of lowering loss in a low Reynolds number region according to claim 9, wherein a blade thickness distribution on an airfoil front portion has an inflection point.

13. The airfoil for an axial-flow compressor capable of lowering loss in a low Reynolds number region according to claim 12, wherein an inflection point exists in a range of 3 to 20% from the leading edge on the chord.

14. The airfoil for an axial-flow compressor capable of lowering loss in a low Reynolds number region according to claim 13, wherein the airfoil is adopted at least in a part of a span direction of an outlet guide vane or a stator vane or a rotor blade of a compressor.

15. The airfoil for an axial-flow compressor capable of lowering loss in a low Reynolds number region according to claim 12, wherein the airfoil is adopted at least in a part of a span direction of an outlet guide vane or a stator vane or a rotor blade of a compressor.

16. The airfoil for an axial-flow compressor capable of lowering loss in a low Reynolds number region according to claim 9, wherein the airfoil is adopted at least in a part of a span direction of an outlet guide vane or a stator vane or a rotor blade of a compressor.

17. The airfoil for an axial-flow compressor capable of lowering loss in a low Reynolds number region according to claim 9, when the shape factor is H, the displacement thickness of the boundary layer is $\delta^*$ and the momentum thickness of the boundary layer is $\theta$, said shape factor H is defined by $H=\delta^*/\theta$.

* * * * *